United States Patent [19]

Young

[11] 4,253,525

[45] Mar. 3, 1981

[54] RETAINER VALVE SYSTEM

[75] Inventor: David E. Young, Friendswood, Tex.

[73] Assignee: Schlumberger Technology Corporation, New York, N.Y.

[21] Appl. No.: 929,620

[22] Filed: Jul. 31, 1978

[51] Int. Cl.[3] ..... E21B 33/035; E21B 43/12

[52] U.S. Cl. ..... 166/336; 137/613; 166/72; 166/321

[58] Field of Search ..... 166/72, 321, 323, 337, 166/336, 340, 319–324; 137/628, 613, 630.16

[56] References Cited

U.S. PATENT DOCUMENTS

| | | | |
|---|---|---|---|
| 3,292,706 | 12/1966 | Grimmer et al. | 166/322 |
| 3,358,755 | 12/1967 | Chisholm | 166/264 |
| 3,750,751 | 8/1973 | Mott | 166/321 |
| 3,856,085 | 12/1974 | Holden et al. | 166/324 |
| 3,861,470 | 1/1975 | Mott | 166/321 |
| 3,967,647 | 7/1976 | Young | 166/321 |
| 4,062,406 | 12/1977 | Akkerman et al. | 166/323 |
| 4,064,937 | 12/1977 | Barrington | 166/321 |
| 4,071,088 | 1/1978 | Mott | 166/321 |
| 4,076,077 | 2/1978 | Nix et al. | 166/321 |
| 4,116,272 | 9/1978 | Barrington | 166/321 |

*Primary Examiner*—James A. Lappink

*Attorney, Agent, or Firm*—David L. Moseley; William R. Sherman

[57] ABSTRACT

In accordance with an illustrative embodiment of the present invention, a new and improved valve system for retaining production fluids in the subsea production pipe upon disconnection of the riser from the subsea wellhead during a production test of an offshore well includes a normally closed valve releasably connected to a normally open valve. The normally open valve can be hydraulically closed from a remote control station upon disconnection of the riser in order to retain fluids in the production pipe thereabove, and when closed will hold pressure in either longitudinal direction.

9 Claims, 5 Drawing Figures

FIG. 1
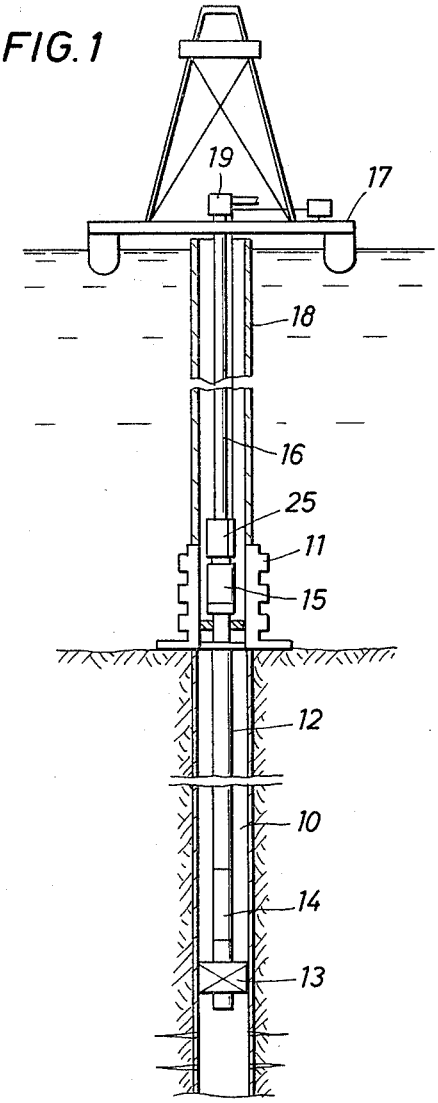
FIG. 3
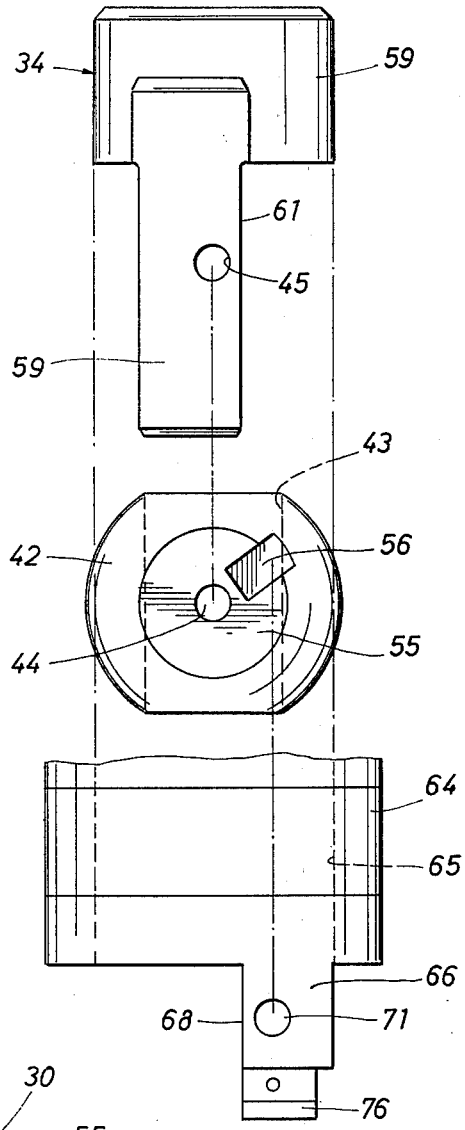
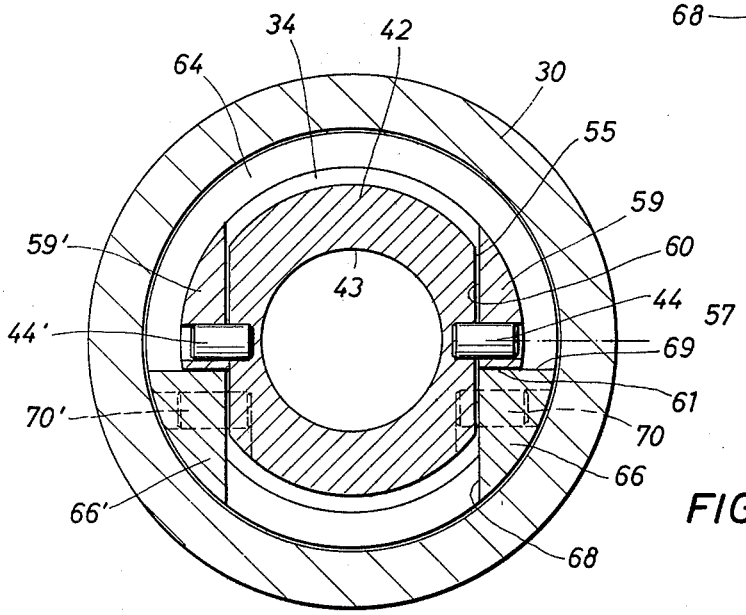
FIG. 4

RETAINER VALVE SYSTEM

This invention relates generally to valve apparatus useful in conducting well testing or other operations from a floating vessel, and specifically to a new and improved retainer valve adapted to be connected near the lower end on a production pipe string that extends downwardly within the riser and selectively operable to trap fluid under pressure within the pipe string upon disconnection of the same from a subsea well head.

In production testing of an offshore well located in relatively deep water, typically a production pipe extends from the vessel downward inside the riser to a remote controlled master valve that is landed inside a subsea blowout preventer stack installed at the ocean floor. Additional production pipe and various testing tools including a packer are disposed in the well bore and are suspended from the subsea master valve. The upper end of the production pipe located within the riser is connected to a flow sub at the rig floor, and from which flow lines are extended to various onboard production testing equipment such as heaters, separators, gauge tanks and burners.

Should an emergency, such as impending storms or the like, occur during the course of a production test, the subsea master valve, shown, for example, in my U.S. Pat. No. 3,967,647 issued July 6, 1976, provides a means for rapidly shutting in the well and disconnecting the pipe to permit moving off the location with the well under complete control. Upon disconnection, it is highly desirable to be able to retain in the pipe any flammable or otherwise dangerous formation fluids under pressure to prevent dumping the same into the riser or into the sea. In addition, it also is desirable to prevent entry into the pipe of riser fluids should the pipe be dry or riser pressure head greater than pipe pressure head.

Accordingly, it is an object of the present invention to provide a new and improved remotely controlled valve apparatus preferably located in the production pipe immediately above a subsea master valve and operable to close the lower end of the pipe when disconnection becomes necessary during the course of a production test.

Another object of the present invention is to provide a new and improved remote controlled retainer valve apparatus of the type described that is normally open and arranged when closed to hold fluid pressure in either direction.

Yet another object of the present invention is to provide a new and improved normally open retainer valve apparatus having hydraulically operated actuator means under the control of separate control line pressures for maintaining the valve open and for causing closure on the same when it is desired to prevent the escape of formation fluids that have been produced into a pipe string.

These and other objects are attained in accordance with the present invention through the provision of a valve apparatus comprising an elongated valve body having flow passage means extending longitudinally thereof, a valve seat surrounding the flow passage, and a ball valve element cooperable with said valve seat for opening and closing the flow passage. An actuator sleeve movable relatively along the body between spaced longitudinal positions carries eccentric means for rotating the ball element, and is engaged by a power spring which causes the ball element to be rotated to a normally open position. Hydraulic piston means connected to the actuator sleeve is sealingly slidable with respect to cylinder means within the body and has oppositely disposed pressure surfaces, one of which is subject to the pressure of a first control fluid and the other of which is subject to the pressure of a second control fluid, whereby said first control fluid may be used to maintain the valve in the normally open position as well as to assist the power spring in returning the valve to open position, and the second control fluid may be used to cause the valve to close.

The present invention has other objects and advantages which will become more clearly apparent in connection with the following detailed description of a preferred embodiment, taken in conjuction with the appended drawings in which:

FIG. 1 is a schematic view of an offshore well undergoing production test;

FIG. 3 is an exploded view of various parts of the valve assembly of FIG. 2B; and FIG. 4 is a cross-section taken on line 4—4 of FIG. 2B.

Figure 2A:
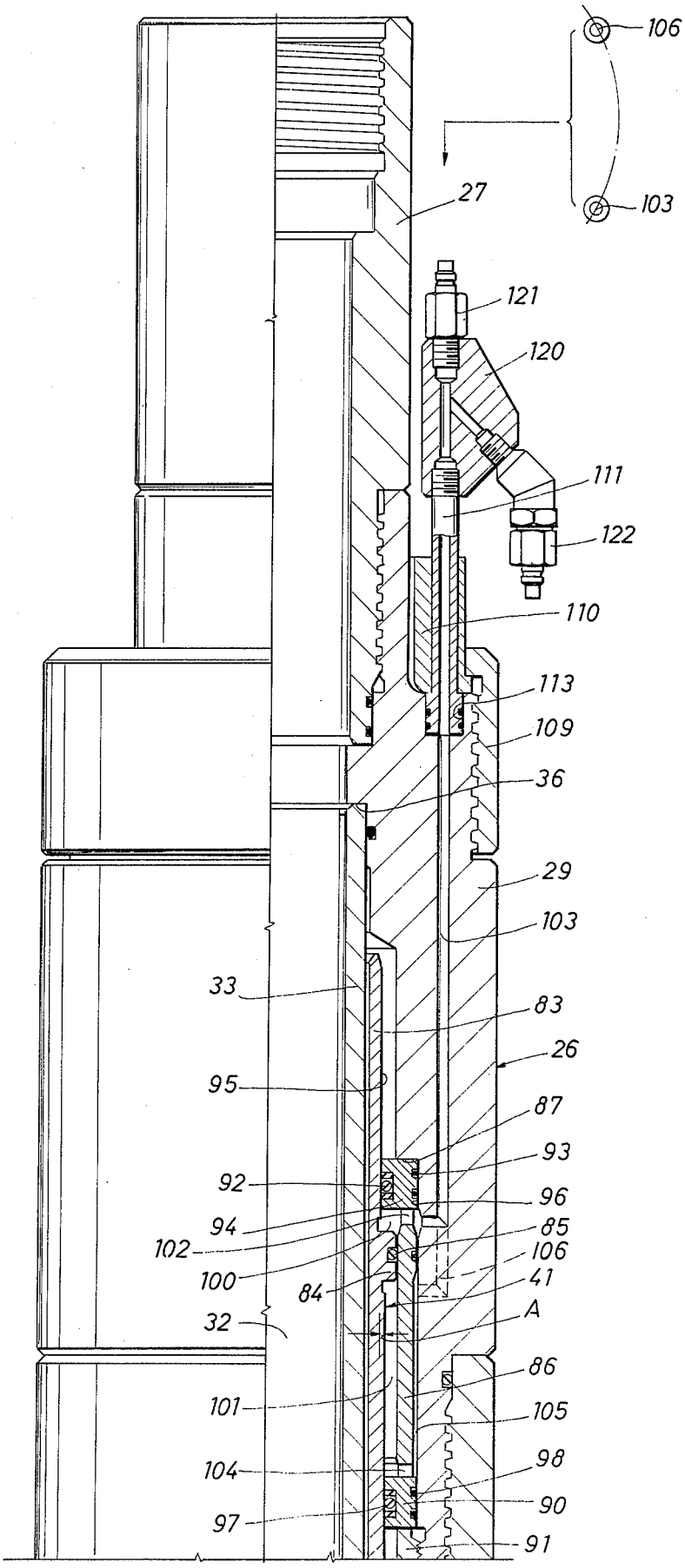
FIGS. 2A and 2B are longitudinal sectional views, with portions in side elevation, of a retainer valve in accordance with this invention with parts in normally open position.

Referring initially to FIG. 1, an offshore well 10 equipped with a subsea BOP stack 11 has a production string of tubing 12 suspended therein. A typical packer 13 at the lower end of the tubing 12 is set to isolate the interval being tested, and a tester valve 14 is employed to control the flow of formation fluids. The tubing 12 has incorporated therein a subsea master valve 15 which is landed in the stack 11 and which is disclosed and claimed in my U.S. Pat. No. 3,967,647, assigned to the assignee of this invention and incorporated herein by reference. A relatively short length of tubing 16 extends from the control valve 15 upwardly to the floating vessel 17 stationed over the well 10, and is located concentrically within a riser 18 which is suspended from the vessel and releasably connected to the well head 11.

During a production test, formation fluids flow from the isolated well interval up through the tubing 12, the master valve 15, the tubing 16 and via a surface flowhead 19 to equipment such as a heater, separator and burner located onboard the vessel 17 where measurement of flow rates, temperatures, pressure, etc. are conducted to determine the production capability of the well. In the event of an emergency, such as impending storms or the like, the well head 11 can be operated to close off the annulus between the casing and the tubing 12, and an emergency disconnect incorporated in the control valve 15 can be actuated as disclosed in the above-referenced patent to disconnect the tubing 16 from the valve leaving the latter in place to close off the tubing 12. Then the riser 18 can be uncoupled from the well head 11 so that the vessel can leave the location until such emergency conditions have abated.

It is quite likely that if disconnect and release of the various components described above become necessary during a production testing operation, the pipe string 16 will be filled with flammable and dangerous formation fluids (oil and gas) under pressure. The undesirability of dumping such fluids into the riser 18 or into the sea upon disconnection will be apparent. To prevent such occurrence and to retain fluids in the tubing 16, a unique valve apparatus 25 constructed in accordance with the present invention is located in the tubing immediately above the control valve 15 and is arranged for remote control from instrumentalities onboard the vessel 17 in order to close the lower end of the tubing and retain therein any fluids present.

Figure 2B:
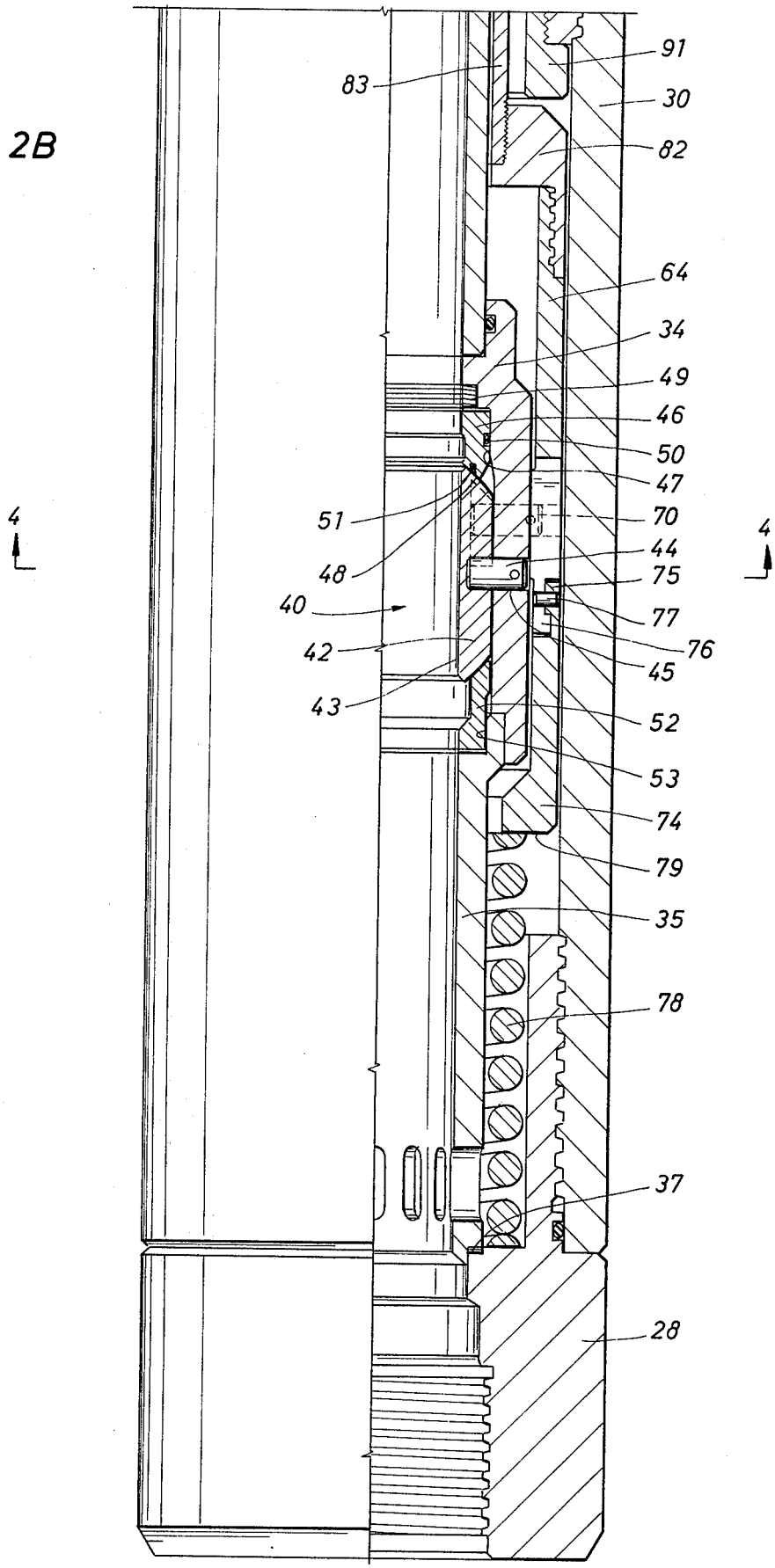

Referring now to FIGS. 2A and 2B for details of construction and operation of the retainer valve 25, an elongated valve body or housing 26 includes upper and lower subs 27 and 28 internally threaded for connection in the tubing 16, a cylinder section 29 and a tubular member 30 threaded together as shown. A flow passage 32 extends axially through the housing 26 and conducts formation fluids upwardly toward the surface during a production test of the well. The passage 32 is defined by an upper flow tube 33, a valve cage 34 and a lower flow tube 35 mounted end-to-end in abutting relationship to provide a rigid structure extending axially of the body 26 from a downwardly facing shoulder 36 on the cylinder section 29 to an upwardly facing shoulder 37 on the lower sub 28. A normally open valve assembly, indicated generally at 40, is arranged to be operated in such a manner as to close the passage 32 in response to vertical movement of a hydraulically controlled actuator assembly indicated generally at 41. The actuator assembly 41 is controlled remotely from a control panel onboard the vessel 17 via hydraulic control lines L-1 and L-2 extending from the retainer valve 25 alongside the tubing 16 to the surface inside the riser 18. As subsequently will be described in greater detail, one line L-1 may be pressurized to cause the valve assembly 25 to close, and the release of applied pressure via this line will enable a power spring to reopen the valve, whereas the other line L-2 may be pressurized to assist the spring if necessary in reopening the valve.

The valve 40 includes a spherical ball element 42 having a through-bore 43 and mounted on trunnion pins 44 and 44′ which extend into diametrically opposed apertures 45 formed in the cage 34, whereby the ball is rotatable between its open position shown in FIG. 2B where the axis of the bore 43 is aligned with the flow passage 32 and a closed position where such axis is at right angles to the flow passage. A seat ring 46 located in an internal annular recess 47 in the cage 34 has a spherical annular seat surface 48 which engages the outer periphery of the ball element, and is biased toward the element by a spring 49. An O-ring 50 and a bonded seal element 51 prevent fluid leakage past the seat when the ball element is rotated to the closed position. A guide ring 52 may be located below the ball element 42 and is seated in an annular recess 53 in the upper end of the lower flow tube 35 and functions to stabilize the ball during rotation thereof.

The ball element 42, shown with certain associated parts in exploded view in FIG. 3 and in cross-section in FIG. 4, has flat outer side walls 55 with each side being provided with an eccentric groove 56 extending radially of the rotation axis 57. The cage 34 has a cylindrical upper portion 58 with oppositely disposed, depending legs 59 and 59′. Each leg has a flat inner wall surface 60 formed parallel to the side walls 55 of the ball 42 and at right angles the axis of rotation of the ball, whereas the end wall surface 60 of each leg also is flat and is laterally offset from the rotation axis. An actuator sleeve 64 has a cylindrical inner wall surface 65 sized to fit slidably over the upper portion 59 of the cage 34, and has depending and inwardly projecting bosses 66 and 66′ formed on its lower end. Each of the bosses has a flat inner surface 68 extending in the same plane as the inner wall surface of a respective cage leg 59 or 59′, and a flat outer face 69 that is slidably relatively along and against the side wall surface 61 of a cage leg. Oppositely disposed eccentric pins 70 and 70′ are fitted within openings 71 in the bosses 66 and 66′ and extend into the grooves 56 in the respective sides of the ball 42, whereby downward movement of the actuator sleeve 64 causes rotation of the ball from the open position shown in FIG. 2B to the closed position shutting off flow through the passage 32, and the reverse or upward movement will cause the ball to open.

As shown in FIG. 2B, a guide collar 74 is attached to the lower ends of the bosses 66 and 66′ by suitable means such as interengaged arcuate ribs 75 and 76 and pins 77, and a coil spring 78 reacts between the lower surface 79 of the collar and the shoulder 37 on the lower sub 28. The spring 78 continuously urges the collar 74 and the actuator sleeve 64 upwardly within the body 25 so that the valve may be considered to be a "normally open" device. The upper end of the actuator sleeve 64 is connected by a collar 82 to a hydraulically controlled actuator mandrel 83 which is movable vertically relative to the body 25 and the upper flow tube 33. An outwardly directed flange 84 intermediate the ends of the mandrel 83 provides a piston head which is slidable and sealed by an O-ring 85 with respect to a cylinder sleeve 86 which is fixed between a downwardly facing shoulder 87 on the cylinder sub 29 and the upper surface of an end ring 90 held by a retainer nut 91. Seals 92 and 93 on the upper enlarged head 94 of the sleeve 86 seal against the outer surface 95 of the mandrel 83 and an inner wall 96 on the sub 29 above the piston head 84, respectively, whereas seals 97 and 98 on the end ring 90 seal against similar surfaces below the piston head. Annular chambers 100 and 101 thus are formed above and below the piston head 84 and have variable capacity depending upon the vertical position of the mandrel 33 relative to the body 25.

The upper chamber 100 is communicated by one or more ports 102 in the cylinder sleeve 86 with a port 103 which extends vertically within the cylinder sub 29 to the upper end thereof, while the lower chamber 101 is communicated via slots 104 or the like cut in the lower end of the cylinder sleeve, and an annular space 105 externally thereof, with a second vertical port 106 (shown in phantom lines since it is circumferentially spaced from the port 103) also leading to the upper end of the cylinder sub. A collar 109 fixed to the upper end of the sub 29 is arranged to retain a fitting 110 through which two control line connectors 111 extend into counterbores 113 in leak-proof communication with the ports 103 and 106.

In operation, the retainer valve 25 is assembled as shown in the drawings and connected in the production string 16 preferably immediately above the subsea control valve 15 so as to be located at the bottom of the short surface string within the riser 18 during a production test of the well. The ball element 42 is normally open during a production test inasmuch as the power spring 78 holds the actuator sleeve 64 in the upper position. Moreover, the mandrel 83 preferably is constructed with a small unbalanced transverse cross-section area A being the difference in seal diameters of the seals 92 and 85 so that the flowing pressure of well fluids passing upwardly through the valve tends to shift the mandrel assembly upwardly.

When it is desired to close the retainer valve 25, a line leading to the port 103 is pressurized at a control station on board the vessel 17. The pressure of the control fluid acts on the upper face of the piston head 84 and forces the control mandrel 83 downwardly within the body 26 to cause corresponding movement of the actuator sleeve 64. This causes the eccentric pins 70 and 70' to rotate the ball 42 about the trunnion pins 44 to the closed position where an outer peripheral surface of the ball sealingly engages the seat surface 48.

When closed, the valve element 42 will hold pressure in either direction. A predominate pressure from below acts across the transverse cross-sectional area of the ball outlined by engagement of the bonded seal 51 with the outer periphery thereof to force the ball into fluid-tight engagement with the seal ring 46. On the other hand, a predominate pressure from above acts on the seat ring 46 across the difference in areas outlined by the O-ring 50 and the bonded seal 51 to force the seat into fluid-tight engagement with the ball 42. The capability of holding pressure from above also permits pressure testing of the valve for leakage. In any event, any fluid produced from the well during the test and remaining within the pipe 16 after disengagement of the control valve 15 cannot escape and pollute the waters or present a fire hazard. Moreover, fluids in the riser 18 cannot enter the pipe 16 should the same be dry or in the event riser pressure is greater than pipe pressure. To reopen the valve, the pressure in the control line leading to the port 103 is bled off at the surface to enable the power spring 78 to shift the actuator sleeve 64 upwardly.

The ports 103 and 106 as previously mentioned are each connected to a control line extending upwardly along the pipe 16 to a hydraulic control panel onboard the floating vessel 17. It is possible and perhaps even preferable to commonly connect such lines with lines used to control the subsea master valve 15 disclosed in my U.S. Pat. No. 3,967,647, whereby the two valve systems may be operated in conjunction with one another. To this end, a tee 120 can be connected to each nipple 111 and have a fitting 121 that connects to the upwardly extending control line, and a second fitting 122 that enables connecting a jumper line (not shown) to the valve system 15. The jumper connected with the port 106 can be coupled with the port designated as "168" in the said patent, so that control line pressure used to open the master valve 15 (which is a normally-closed device) tends to maintain the retainer valve 25 disclosed herein in the open position. The other jumper connected with the port 103 is hydraulically coupled with the port designated as "189" in said patent so that line pressure used to assist in the closing of the master valve 15 also acts on the upper face of the piston 84 to shift the mandrel 83 downward and close the ball element 42. Thus, should the ball element 42 be open and a wireline tool disposed in the well, the same control line pressure may be utilized to cause cutting of the wireline on which the tool is suspended as is used to assist in closure of the ball element 42 as herein described.

It now will be recognized that a new and improved retainer valve apparatus has been disclosed which is adapted primarily for use in production testing of an offshore well. The valve is normally open to permit flow of formation fluids during a test of the well, but can be closed with surface controlled pressure to retain fluids in the production pipe thereabove, and to prevent entry of sea water into the pipe thereabove upon disconnection with respect to a subsea master valve. The valve actuator mandrel is designed so that flowing fluid pressure tends to maintain the valve open. Inasmuch as the ball element, seat ring and seal design enables the ball element when closed to hold pressure in either longitudinal direction, the pipe string thereabove may be tested for its ability to hold pressure when the valve is closed. Since certain changes or modifications may be made by those skilled in the art without departing from the inventive concepts involved, it is the aim of the appended claims to cover all such changes and modifications falling within the true spirit and scope of the present invention.

I claim:

1. Valve apparatus adapted for use in a well, comprising:

an elongated body having means at each end adapted for connection to a pipe string, said body having a tubular structure extending concentrically thereof defining a flow passage, said tubular structure and body having portions laterally spaced to provide an annular cavity therebetween;

normally open valve means including a valve element mounted on said tubular structure and arranged for rotation about a fixed transverse axis between an open position and a closed position with respect to such flow passage;

actuator means movable longitudinally in said cavity and carrying eccentric means cooperable with said valve element for rotating said valve element between said open and closed positions;

hydraulically operable means in said cavity coupled to said actuator means and responsive to the pressure of a control fluid in a control line for closing said valve means; and spring means cooperable with said actuator means for tending to open said valve means.

2. The apparatus of claim 1 wherein said hydraulically operable means includes first and second pressure responsive areas facing in opposite longitudinal directions, said first pressure responsive area being subject to the pressure of a first control fluid for enabling closing of said valve means, and said second pressure responsive area being subject to the pressure of a second control fluid for assisting said spring in opening said valve means.

3. The apparatus of claim 2 wherein said hydraulically operable means includes a downwardly facing unbalanced cross-sectional area subject to the pressure of fluid in said flow passage whereby the pressure of fluids flowing upwardly through said passage applies opening force to said valve means.

4. The apparatus of claim 1 wherein said valve means includes a ball element and a valve seat, said seat surrounding said flow passage and being sealed with respect to said tubular structure and said ball element in a manner such that said valve means when closed will hold a predominate pressure from above or below.

5. A valve system adapted for use in retaining well fluids in a production pipe extending from a floating vessel to a subsea wellhead during a production test on an offshore well, comprising:

normally closed first valve means connected to the upper end of a pipe string extending into a well and adapted to be landed in the subsea wellhead;

hydraulically operable control means releasably connected to said normally closed first valve means and arranged for opening thereof in response to the pressure of a first control fluid; and normally open second valve means connected to and above said control means and to the lower end of a pipe string extending upwardly to the vessel, said normally open second valve means including actuator means for closing same in response to the pressure of a second control fluid.

6. The valve system of claim 5 including pressure operated means for assisting in the closing of said first valve means.

7. The valve system of claim 6 wherein said actuator means and pressure operated means are hydraulically coupled together to enable joint operation thereof by said second control fluid.

8. The valve system of claim 5 wherein said actuator means includes a downwardly facing unbalanced cross-sectional area subject to the pressure of fluids flowing upwardly therethrough whereby the pressure of such fluids tends to open said normally open second valve means.

9. The valve system of claim 5 wherein said normally open second valve means includes a valve body defining a flow passage, a ball element, and a valve seat, said seat surrounding said flow passage and being sealed with respect to said ball element and said body in such a manner that said normally open second valve means when closed will hold a predominate pressure from above or below.

* * * * *